United States Patent [19]
Casull

[11] 4,228,606
[45] Oct. 21, 1980

[54] MEANS FOR MOUNTING CYLINDER TO FRAME OF SMALL HAND GUN

[76] Inventor: Richard J. Casull, P.O. Box 276, Freedom, Wyo. 83120

[21] Appl. No.: 961,979

[22] Filed: Nov. 20, 1978

[51] Int. Cl.³ ..... F41C 1/00
[52] U.S. Cl. ..... 42/59
[58] Field of Search ..... 42/59, 65, 62

[56] References Cited

U.S. PATENT DOCUMENTS

| | | | |
|---|---|---|---|
| 884,119 | 4/1908 | Zaiser | 42/59 |
| 2,955,373 | 10/1960 | Ruger | 42/59 |
| 3,613,285 | 10/1971 | Kennedy | 42/59 |

*Primary Examiner*—Charles T. Jordan
*Attorney, Agent, or Firm*—Criddle & Western

[57] ABSTRACT

Improved means for releasably locking the cylinder of a small, single action revolver in proper rotatable position within the frame of the revolver. A cylinder axis pin is adapted to extend through a first bore in the front portion of the frame, then through a central bore in the cylinder, and into a bore in the rear portion of the frame which is axially aligned with the first bore. A counterbore is provided in the front portion of the frame extending inwardly into the front portion of the frame coaxially with the first bore therein. A lip extends downwardly over the top portion of the counterbore at its open end, i.e., at the front or barrel side of the front portion of the frame. A cylindrical coil spring is positioned in the counterbore so that the cylinder axis pin can slide longitudinally through the open cylindrical portion of the spring. A lug extends from the cylindrical surface of the pin and is adapted to slide past the lip at the opening of the counterbore and push against the coil spring when the pin is pushed through the first bore and the bore in the cylinder, with the lug extending downwardly away from the lip. When the lug on the pin has been pushed past the lip and into the counterbore, the pin is rotated. The coil spring biases the lug into firm contact with the lip at the opening of the counterbore, thereby releasably locking the pin and, thus, the cylinder in place.

4 Claims, 3 Drawing Figures

MEANS FOR MOUNTING CYLINDER TO FRAME OF SMALL HAND GUN

BACKGROUND OF THE INVENTION

1. Field:

The invention relates to small, single action revolvers and more particularly to improved means for releasably locking the rotatable cylinders within the frames of such revolvers.

2. State of the Art:

Revolvers of various sizes and shapes are well known in the art. In almost all these revolvers means are provided for removably securing the rotatable cylinder in proper position in the frame of the revolver. With conventional, large size hand guns, the cylinder lock can be rather easily accommodated and various cams or levers can be used to releasably lock the cylinder axis pin in engagement with the frame of the revolver cylinder in proper sequence during cocking of the hammer. An example of cylinder lock for such conventional revolvers is shown in U.S. Pat. No. 2,733,529, issued to William B. Ruger on Feb. 6, 1956.

In smaller sized revolvers it is much more difficult to properly position all the actuating components, and the size of the components must often be greatly reduced. The reduced size of the components often results in a weakening thereof which may cause early failure of the revolver.

Objectives:

The principal objective of the present invention is to provide an improved compact means for releasably locking the cylinder of a small sized revolver in rotatable position within the frame of the revolver.

Another objective is to provide a simplified locking mechanism that is of inherently durable construction.

SUMMARY OF THE INVENTION

The above objectives are achieved in accordance with the present invention by providing an improved cylinder axis pin and means for releasably locking the cylinder axis pin in engagement with the frame of the revolver. The improved cylinder axis pin comprises an elongate, substantially cylindrical pin having a lug extending from the cylindrical surface of the pin in a direction substantially normal to the cylindrical axis of the pin. In a preferred embodiment, the lug on the pin comprises a collar-like projection which encircles a portion of the pin.

The means for releasably locking the cylinder axis pin in engagement with the frame of the revolver comprises axially aligned, pin-receiving bores in the front and rear portions, respectively, of the frame and a central bore in the cylinder. A counterbore is provided in the front portion of the frame extending inwardly from the front or barrel side of the front portion of the frame. The counterbore is coaxial with the pin-receiving bore in the front portion of the frame and has a radius at least equal to the sum of the radius of the pin-receiving bore in the front portion of the frame and the height of the lug which extends from the cylindrical surface of the pin.

A cylindrical coil spring is positioned in the counterbore, a lip is provided at the entrance to the counterbore extending downwardly from the top portion of the counterbore without covering any portion of the open end of the bore in the front portion of the frame. The distance which the lip extends downwardly from the top of the counterbore is no more than the height of the lug which extends from the cylindrical surface of the pin.

When the cylinder is placed in the frame with the central bore of the cylinder in axial alignment with the bores in the front and rear portions of the frame, the cylinder axis pin can be inserted axially through the aligned bores thereby securing the cylinder to the frame. The pin is releasable locked in engagement with the frame of the revolver by positioning the lug thereon in a downward direction as the pin is inserted through the aligned bores, so that as the pin is pushed into its fully engaged position in the aligned bores, the lug slides just beyond the lip at the opening of the counterbore and into engagement with the coil spring. When the lug has cleared the lip and is within the counterbore, the pin is rotated about its longitudinal axis, so that the lug thereon extends upwardly behind the lip at the opening of the counterbore. When the pin is released, the coil spring biases the lug into contact with the lip, thus preventing inadvertent withdrawal of the pin from the aligned bores. To remove the cylinder from the frame, the pin is rotated so that the lug thereon clears the lip at the opening of the counterbore, and the pin is removed from the aligned bores, thereby freeing the cylinder from engagement with the frame. The pin can be pushed toward the handle end of the gun as it is being rotated to overcome the spring forced contact between the lug and the lip.

Additional objects and features of the invention will become apparent from the following detailed description, taken together with the accompanying drawings.

THE DRAWINGS

A particular embodiment of the present invention representing the best mode presently contemplated of carrying out the invention is illustrated in the accompanying drawings, in which.

DETAILED DESCRIPTION OF THE PREFERRED EMBODIMENTS

Figure 2:
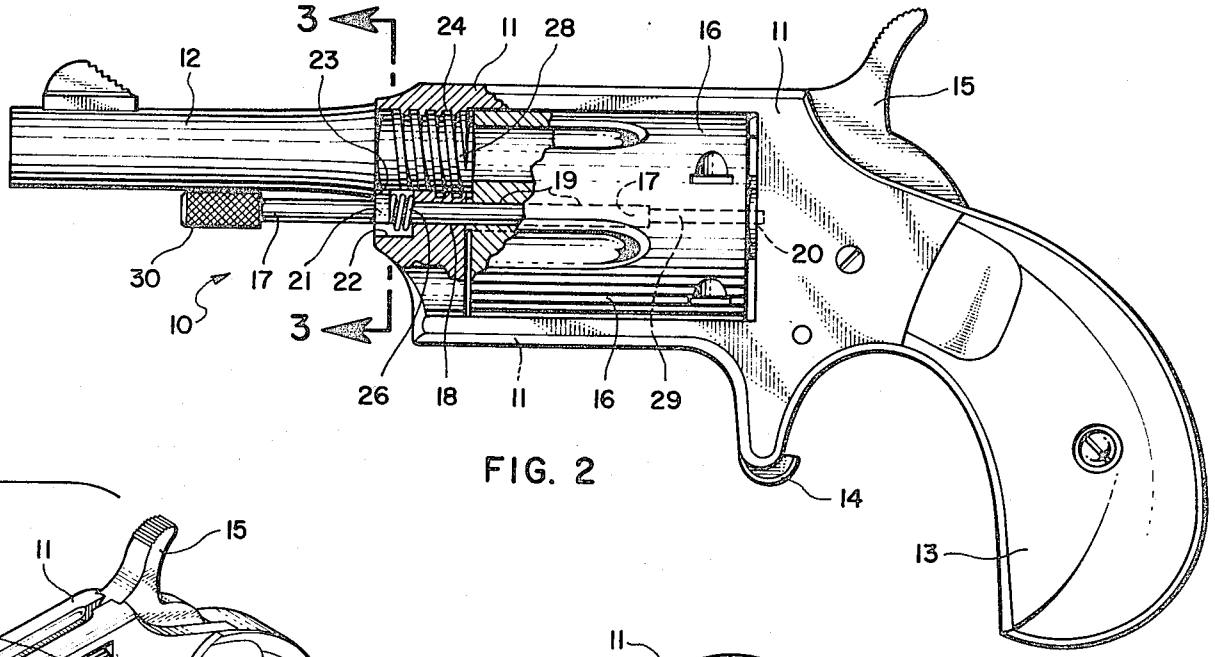
FIG. 2 is a side elevation view of the revolver of FIG. 1, with a portion of the frame and cylinder broken away to show the cylinder axis pin in its operative position in the forward portion of the frame of the revolver.

A preferred embodiment of the revolver in accordance with this invention is shown in the drawings, wherein the revolver, shown generally by the reference numeral 10, has the usual frame 11, with a barrel 12 and a handle 13. The revolver 10 further comprises a trigger 14 and a hammer 15. The hammer includes a thumb projection to be used in pivoting the hammer 15 to a cocked position. The trigger 14 is activated when the hammer 15 is cocked, so that when the trigger 14 is pulled, the hammer 15 is pivoted forward to fire the revolver 10. A revolvable cylinder 16 having a plurality of cartridge-receiving chambers is mounted in the frame 11, and as well known in the revolver art, the cylinder 16 is partially rotated each time the hammer 15 is cocked, to bring the next or subsequent chamber in the cylinder into its firing position in alignment with the barrel.

The mechanism heretofore described, including the revolver frame in general, the handle, barrel, the means for operating the cylinder in response to cocking the hammer, and the trigger are all well known in the revolver art and do not, per se, constitute part of the present invention. In accordance with the present invention, improved means are provided for releasably locking the cylinder 16 within the frame 11.

Figure 3:
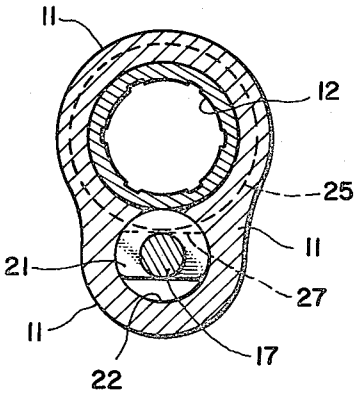
FIG. 3 is a transverse sectional view taken on line 3—3 of FIG. 2.

As illustrated, an improved cylinder axis pin 17 is provided which extends through a first bore 18 (FIG. 2) in the front portion of the frame 11, then through a central bore 19 (FIG. 2) in the cylinder 16, and into a bore 20 (FIG. 2) in the rear portion of the frame 11 which is axially aligned with the first bore 18. The axis pin 17 comprises an elongate, substantially cylindrical pin having a lug extending from the cylindrical surface of the pin in a direction substantially normal to the cylindrical axis of the pin. As shown in the illustrated, preferred embodiment of the invention, the lug extending from the pin comprises a collar-like projection 21 which encircles only a portion of the pin 17. As best shown in FIG. 3, the lug 21 appears as a circular collar on the pin 17 which has been ground off on one side to form a flat surface tangential to the cylindrical surface of the pin 17. The lug 21 as shown in the drawings is advantageously formed by just such a process.

Cooperating means for releasably locking the cylinder axis pin 17 in engagement with the frame 11 of the revolver comprises a counterbore 22 extending inwardly, coaxially with the aligned bores 18 and 20 in the frame 11, into the front portion of the frame 11 from the front or barrel side thereof, i.e., the side of the frame 11 from which the barrel projects. The counterbore 22 has a radius at least equal to the radius of bore 18 in the front portion of the frame 11 plus the height of the lug 21 extending from the cylindrical surface of the pin 17. The depth of the counterbore 22 is not, per se, critical, other than that it should not extend completely through the front portion of the frame 11, as there would then, of course, be no bearing support for the pin at the front of the cylinder 16.

A downwardly extending lip 23 (FIG. 1) at the front or barrel side of the front portion of the frame 11 covers the top portion of the open end of the counterbore 22 without covering any portion of the open end of bore 18 therein. In the illustrated embodiment, the breech end of the barrel 12 has a threaded portion 28 (FIGS. 1 and 2) which engages a threaded bore 24 in the frame 11, with the threaded portion 28 of the barrel 12 having a smaller diameter than the immediate adjacent poriton of the barrel 12. Thus, a flat abutment is formed encircling the base of the threaded portion 28 of the barrel 12. The flat abutment forms a flat seat which is firmly seated against the frame 11, when the barrel 12 is threaded into its operable position within the threaded bore 24. In addition, the flat abutment or seat also advantageously forms the downwardly extending lip 23 of the present invention. As is clearly shown in FIGS. 1 and 3, the perimeter of the flat abutment or seat (as shown by dotted line 25 of FIG. 3) overlaps and covers the top portion of the counterbore 22, and the overlapping portion of the flat abutment or seat forms the lip 23 over the top portion of the counterbore 22.

Figure 1:
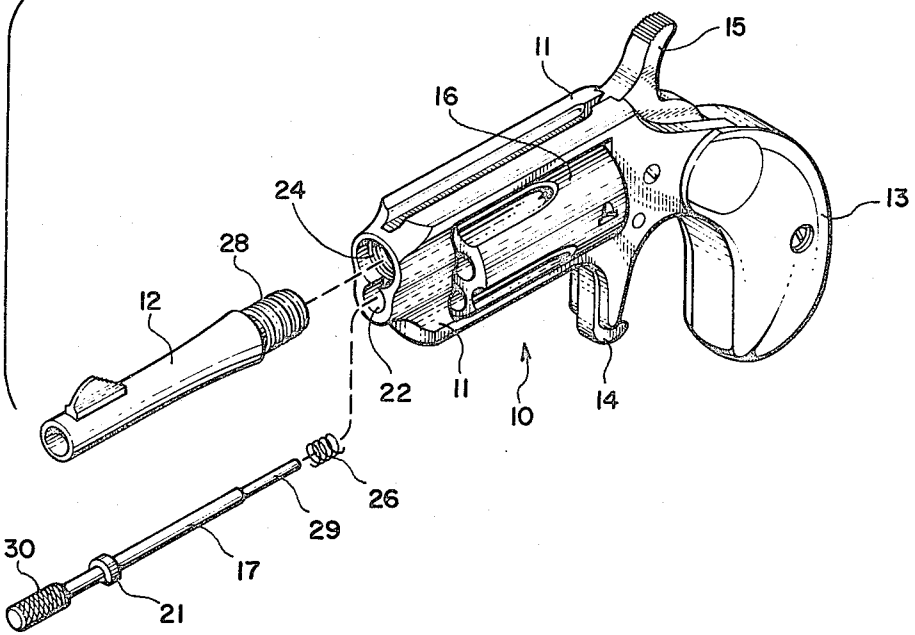
FIG. 1 is an exploded perspective view of a small revolver incorporating the releasable locking mechanism of this invention.

A cylindrical coil spring 26 is positioned within the counterbore 22, so that the pin 17 passes axially through the spring 26 when the pin 17 is engaged in the frame 11 in its operative position. In positioning the pin in its operative position so as to lock the cylinder 16 within the frame 11, the bore 19 in cylinder 16 is aligned with the bores 18 and 20 in the front and rear portions of the frame 11, respectively. The pin 17 is inserted axially to extend through the aligned bores from the front to the back of the frame 11. During the insertion, the pin 17 is oriented so that the lug 21 (the collarlike projection encircling a portion of the pin as shown in the drawings) is directed downward away from the lip 23 which covers the top portion of the counterbore 22. In such an orientation, the flat surface of the lug 21 is positioned as shown by dotted line 27 in FIG. 3, and the lug 21 is free to slide past the lip 23 as the pin 17 is pushed into its operative position. The pin is releasably locked in engagement with the frame 11 in its operative position by rotating the pin 17 so that the lug 21 extends upwardly as shown in FIGS. 1 and 2. The coil spring 26 provides a biasing force resulting from the lug 21 being pushed against it. The biasing force holds the lug 21 in firm engagement with the lip 23. In removing the pin 17 from its operable position so that the cylinder 16 can be removed from the frame 11, the pin 17 is pushed slightly inwardly to free the lug 21 from contact with the lip 23. The pin 17 is then rotated until the lug 21 extends downwardly so as to clear the lip 23, and the pin is then retracted from the aligned bores in the frame 11 and the cylinder 16.

In the preferred embodiment as illustrated, the pin 17 has a reduced diameter section 29 extending coaxially from one end thereof. The bore 19 in the cylinder 16 has a reduced diameter section which engages the section 29 when the pin 17 is in its operable position and, of course, the bore 20 in the back of the frame 11 is of a proper diameter to engage the end of the section 29 of the pin 17. A knurled section 30 is preferably provided at the free end of the pin 17 to aid in inserting the pin 17 into and removing the pin 17 from the frame 11.

The cylindrical coil spring 26 preferably has a cylindrical diameter just large enough so that the spring is retained in the counterbore 22 by lip 23 after the pin 17 has been withdrawn therefrom. This prevents inadvertent misplacement and/or loss of the spring 26 during periods when the cylinder 16 has been removed from the revolver.

The present invention is particularly adaptable for use in very small hand revolvers having an overall length of from about 4 to about 6 or so inches. In such small revolvers, the cylinder is removed from the frame of the revolver in loading and removing shells from the chambers in the cylinder. The present invention provides a compact axis pin assembly which permits rapid, easy removal and replacement of the cylinder in such revolvers.

Although a preferred embodiment of the invention, which is presently contemplated as the best mode of carrying out the invention, has been illustrated and described, it is to be understood that the present disclosure is made by way of example and tha variations are possible without departing from the subject matter coming within the scope of the following claims, which subject matter I regard as my invention.

I claim:

1. In a small, single action revolver of the type comprising a frame including a handle and a barrel, a cylinder having a plurality of cartridge-receiving chambers and being rotatably mounted in the frame by a cylinder axis pin which extends through a central bore in the cylinder and engages axially aligned bores, respectively, in the front and rear portions of the frame, and a hammer mounted to the frame for reciprocal, pivotal movement between fired and cocked positions, with said cylinder being adapted for partial rotation each time the hammer is pivoted from its fired position to its cocked position, the improvement comprising a particular cylinder axis pin and cooperating means for releasably locking the cylinder axis pin in engagement with the frame of the revolver, said particular cylinder axis pin comprising an elongate, substantially cylindrical pin having a lug extending from the cylindrical surface of the pin in a direction substantially normal to the cylindrical axis of said pin, and said cooperating means for releasably locking the cylinder axis pin in engagement with the frame comprising a counterbore extending inwardly, coaxially with said aligned bores in said frame, into the front portion of the frame from the front or barrel side thereof, with said counterbore having a radius at least equal to the radius of said bore in said front portion plus the height of said lug extending from the cylindrical surface of said pin, a downwardly extending lip at the front or barrel side of said front portion of said frame, said lip covering the top portion of the open end of said counterbore without covering any portion of the open end of said bore in said front portion of the frame; and a cylindrical coil spring positioned in said counterbore, whereby when the cylinder is placed in the frame in axial alignment with said bores in the front and rear portions of the frame, respectively, and when said pin is aligned with said bores with the lug extending in a downward direction away from the lip covering the top portion of said counterbore, said pin can be inserted from the front or barrel side of said front portion through the coil spring in said counterbore so as to extend through the bore in said front portion, the bore in said cylinder and into the bore in said rear portion, and the pin is releasably locked in engagement with the frame by pushing the pin sufficiently into said bores so that said lug thereon pushes against said coil spring and slides past said lip into said counterbore, whereupon the pin is rotated so that when the pin is released, the spring pushes the lug thereon into contact with said lip.

2. An improved single action revolver in accordance with claim 1, wherin the breech end of the barel of said revolver has a threaded portion which engages a threaded bore in the front portion of the frame, said threaded portion having a smaller diameter than the portion of the barrel adjacent thereto, so as to form an essentially flat abutment encircling the base of the threaded portion so that when the barrel is engaged in the threaded bore, the flat abutment overlaps said counterbore to form said lip extending downwardly over the top portion of said counterore.

3. An improved single action revolver in accordance with claim 1, wherein the lug on said pin comprises a collar-like projection encircling a portion of the pin.

4. An improved single action revolver in accordance with claim 1, wherein the pin has a reduced diameter section extending coaxially from one end thereof for engaging the bore in the rear portion of the frame, and a knurled portion at the other end thereof for manually manipulating said pin.

* * * * *